US007107689B2

(12) United States Patent
Keeton et al.

(10) Patent No.: US 7,107,689 B2
(45) Date of Patent: Sep. 19, 2006

(54) BAR KNOB WITH INTEGRATED LOCK

(75) Inventors: William B. Keeton, Nash, TX (US); Paul A. Warfel, Texarkana, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 35 days.

(21) Appl. No.: 10/961,107

(22) Filed: Oct. 8, 2004

(65) Prior Publication Data

US 2006/0075644 A1 Apr. 13, 2006

(51) Int. Cl.
*B27B 17/14* (2006.01)
*B27B 17/02* (2006.01)

(52) U.S. Cl. ..... 30/386; 30/383

(58) Field of Classification Search ..... 30/381, 30/383, 386; 83/816
See application file for complete search history.

(56) References Cited

U.S. PATENT DOCUMENTS

| | | | | |
|---|---|---|---|---|
| 3,267,973 | A * | 8/1966 | Beard | 30/386 |
| 3,636,995 | A * | 1/1972 | Newman | 30/386 |
| 5,174,029 | A * | 12/1992 | Talberg | 30/386 |
| 5,491,899 | A | 2/1996 | Schliemann et al. | 30/386 |
| 5,522,143 | A | 6/1996 | Schliemann et al. | 30/386 |
| 5,528,835 | A | 6/1996 | Ra | 30/386 |
| 5,896,670 | A | 4/1999 | Gibson et al. | 30/386 |
| 6,032,373 | A | 3/2000 | Peterson | 30/386 |
| 6,148,525 | A | 11/2000 | Mizutani et al. | 30/386 |
| 6,493,949 | B1 | 12/2002 | Kondo et al. | 30/386 |
| 6,532,671 | B1 | 3/2003 | Jong | 30/386 |
| 6,560,879 | B1 | 5/2003 | Franke et al. | 30/386 |
| 6,564,459 | B1 | 5/2003 | Steinbrueck et al. | 30/383 |
| 6,782,627 | B1 * | 8/2004 | Hermes et al. | 30/386 |
| 6,877,233 | B1 * | 4/2005 | Franke | 30/386 |

* cited by examiner

*Primary Examiner*—Hwei-Siu Payer
(74) *Attorney, Agent, or Firm*—Pearne & Gordon LLP

(57) ABSTRACT

A retaining assembly is provided for a tensioning arrangement for adjusting the tension of the cutting chain in the chainsaw. The retaining assembly includes a knob body, a lock, and a lever. The lock and lever rotate about a common axis, which is perpendicular to an axis of rotation of the retaining assembly. The lock includes a tooth adapted to engage with teeth on a clutch cover of a chainsaw to lock the retaining assembly in place.

14 Claims, 5 Drawing Sheets

BAR KNOB WITH INTEGRATED LOCK

FIELD OF THE INVENTION

The present invention relates to a retaining assembly for a tensioning arrangement for periodically adjusting the tension of an endless cutting chain on the guide bar of a chainsaw.

BACKGROUND OF THE INVENTION

The cutting chain of a chainsaw, eventually, will become loose on the chainsaw's guide bar after use because of factors, such as wear, that result in elongation of the chain. Several chainsaw constructions and associated methods exist to move the guide bar longitudinally away from the drive sprocket of the chainsaw to remove slack from the cutting chain and apply the requisite tension to the cutting chain. This ensures that the links of the cutting chain remain snuggly seated in a peripheral channel in the guide bar.

A number of tensioning arrangements and associated methods for adjusting the tension of the cutting chain on the guide bar are known. Typically, retaining assemblies are provided for the tensioning arrangements. The retaining assemblies function so as to hold the guide bars in place. When it is necessary to reposition the guide bar and adjust the tension of the cutting chain, the retaining assembly is loosened so that the guide bar can be moved longitudinally from the drive sprocket to increase the tension in the cutting chain. Thereafter, the retaining assembly is retightened to secure the guide bar in its adjusted position. In some instances, separate tools are required to loosen and tighten the retaining assemblies. In other cases the retaining assemblies include means for their loosening and tightening and separate tools are not required. Additionally, in certain constructions and associated methods, screws, hydraulic pistons or eccentric working parts are integrated into the chainsaw and are employed to, essentially, automatically move the guide bar and increase the tension in the cutting chain when the retaining assembly is loosened. In other instances, the guide bar is manually repositioned by the operator grasping and moving the guide bar to its adjusted position.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a retaining assembly for adjusting a tension of a cutting chain of a chainsaw having an engine chassis, a clutch cover, and a guide bar for the cutting chain, the retaining assembly includes: a rotatable knob operatively coupled to the engine chassis, the clutch cover, and the guide bar, wherein the knob is rotated about a rotational axis between a tightened position, in which the guide bar is fixed in place between the engine chassis and the clutch cover, and a loosened position, in which the guide bar is loosened and may be repositioned to adjust the tension of the cutting chain on the guide bar; a lock operatively coupled to the rotatable knob and having a least one locking member projecting in a direction that is parallel to an axis of rotation of the rotatable knob; and a lever operatively coupled to the rotatable knob and the lock such that movement of the lever moves the at least one locking member into and out of engagement with teeth provided on the clutch cover.

In accordance with another aspect of the present invention, a retaining assembly for adjusting a tension of a cutting chain of a chainsaw includes: rotatable means for repositioning a guide bar to adjust the tension of the cutting chain; locking means for engaging and disengaging with teeth on a clutch cover of the chainsaw in a direction parallel to an axis of rotation for the rotatable means; and lever means for pivoting the locking means to effect actuation of the locking means.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
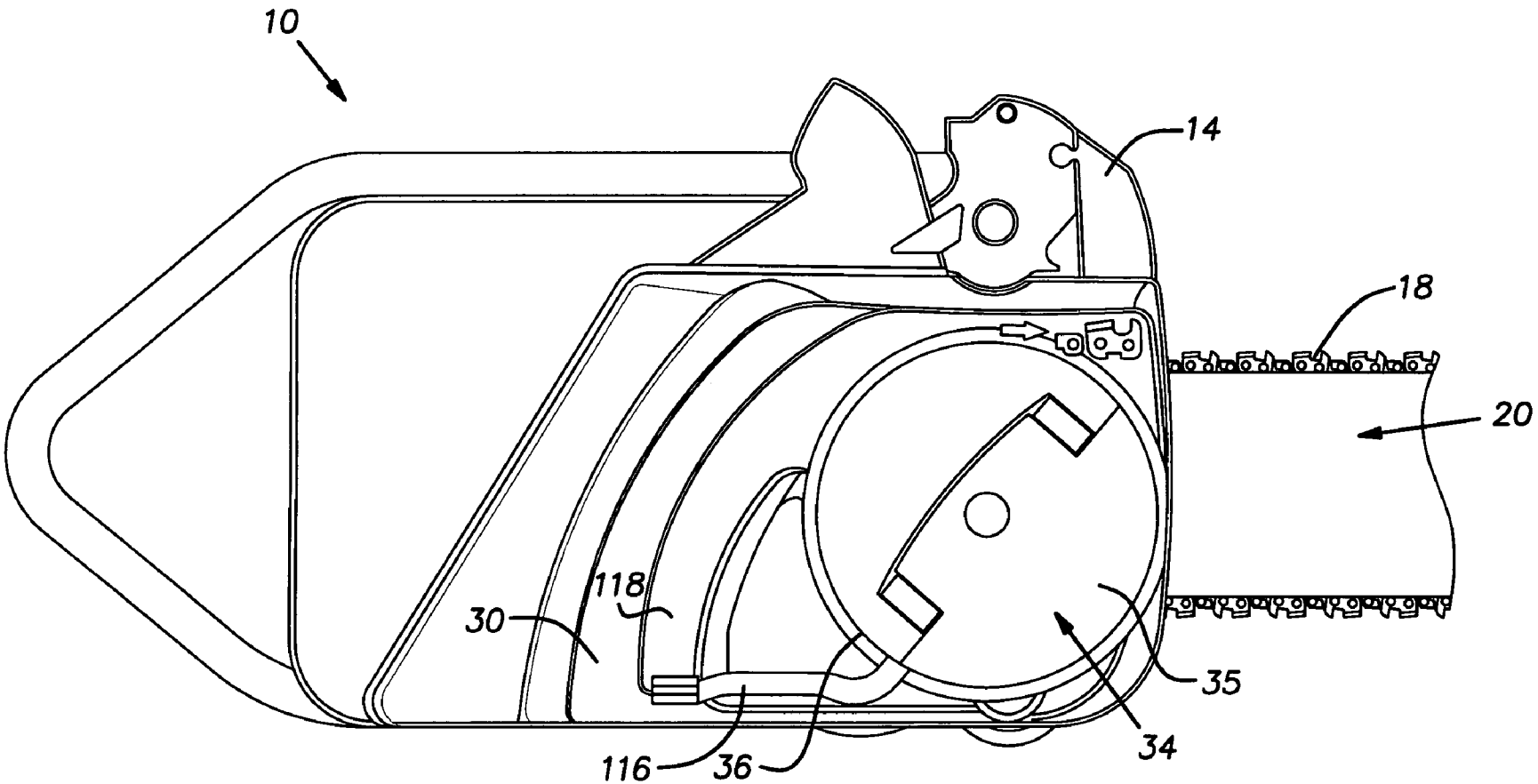
FIG. 1 is a side elevation view of a portion of a chainsaw that includes an example of the present invention.

The present invention provides a system for adjusting a tension of an endless cutting chain of a chainsaw. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
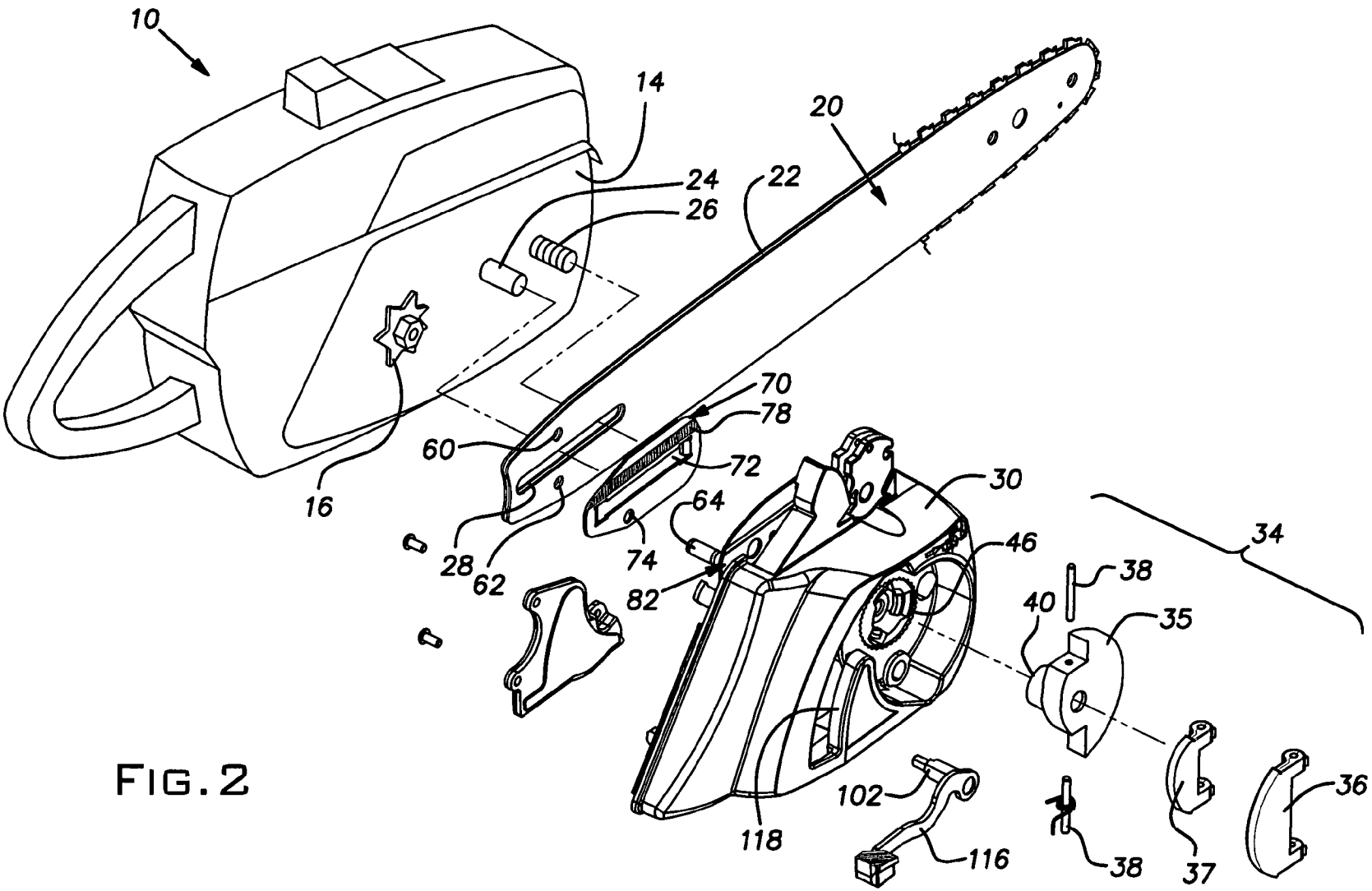
FIG. 2 is an exploded perspective view of the chain saw of FIG. 1 looking toward the engine chassis of the saw.
Figure 3:
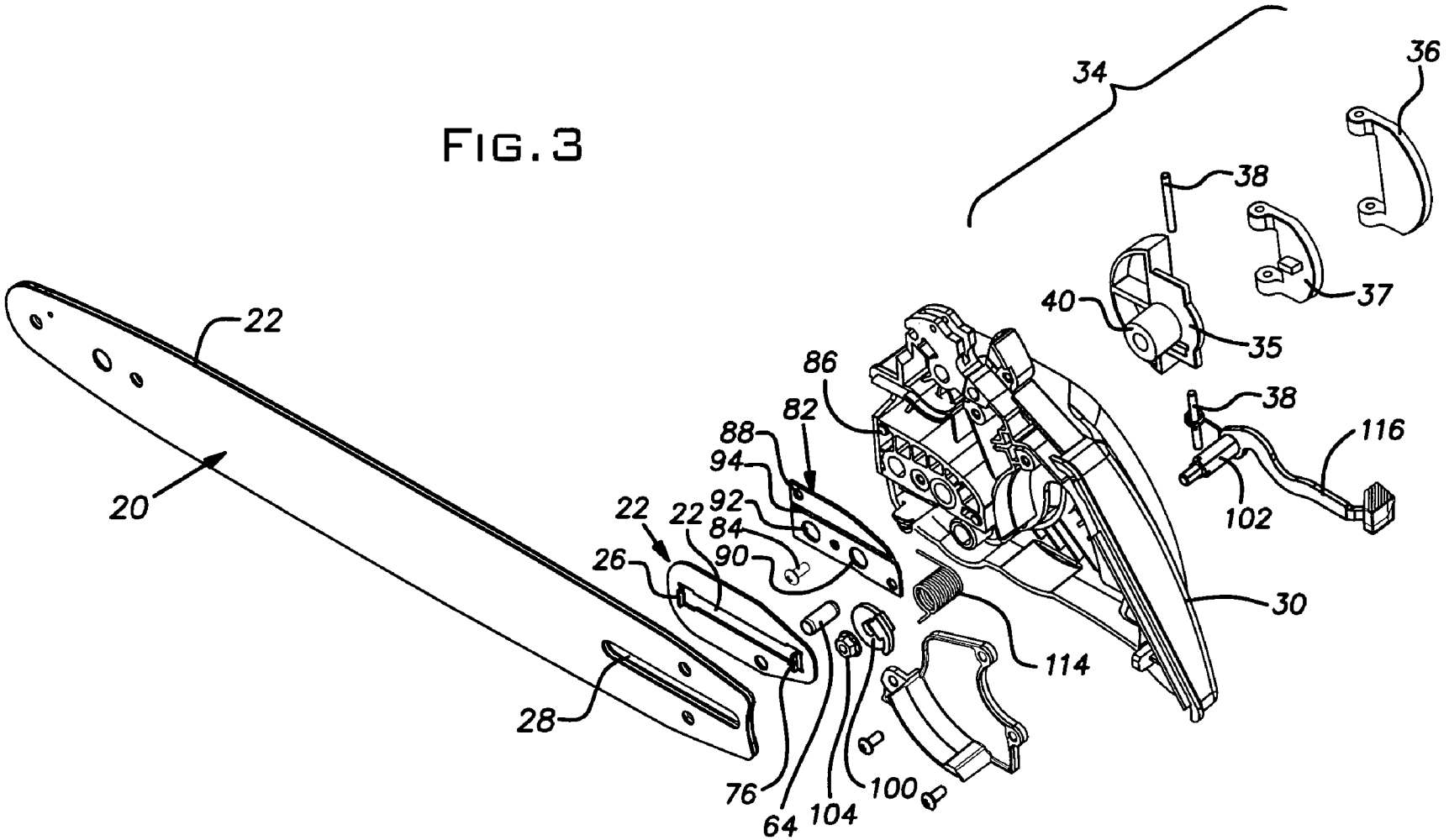
FIG. 3 is an exploded perspective view of some of the components of the chain saw of FIG. 1 looking away from the engine chassis of the saw.
Figure 4:
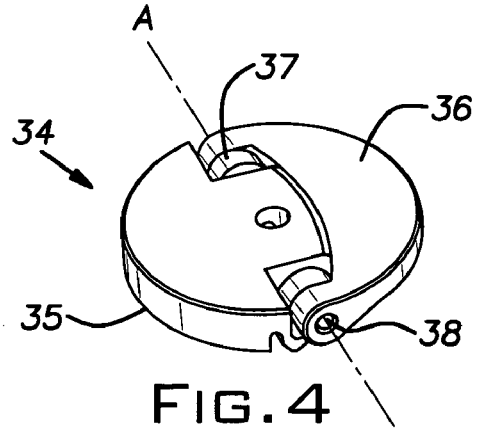
FIG. 4 is a top perspective view of a retaining assembly in accordance with an aspect of the present invention.
Figure 5:
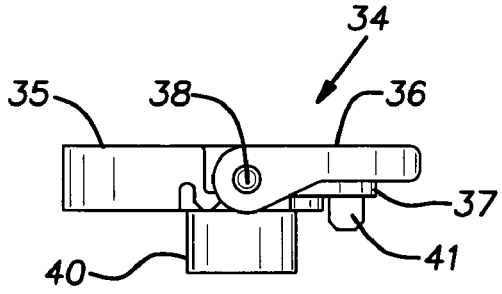
FIG. 5 is a side view of the retaining assembly of FIG. 4.
Figure 6:
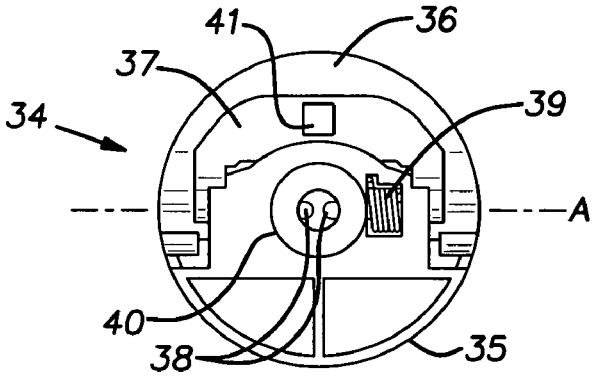
FIG. 6 is a bottom view of the retaining assembly of FIG. 4.
Figure 7:
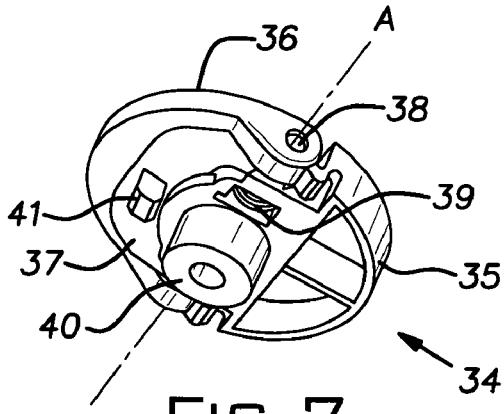
FIG. 7 is a bottom perspective view of the retaining assembly of FIG. 4.

FIGS. 1–3 illustrate a chainsaw 10 that includes an example of a retaining assembly 34 for a tensioning arrangement for adjusting a tension of the chainsaw's endless cutting chain 18 (FIG. 1) in accordance with an aspect of the present invention. The chainsaw 10 includes an engine chassis 14 for an engine (not shown), a clutch cover 30 and a guide bar 20 for the cutting chain 18. As will be understood, the engine powers a drive sprocket 16 (FIG. 2) attached to a drive shaft (not shown) of the engine. The drive sprocket 16 engages the links of the cutting chain 18 and propels the cutting chain 18 around the guide bar 20.

The guide bar 20 has the configuration of an elongated plate with a channel or groove 22 (FIGS. 2 and 3) around its periphery and an idler sprocket (not shown) at its distal end in which the links of the cutting chain 18 ride. Parallel pins, or studs, 24 and 26 are affixed to the chassis 14 and lie in a common plane that is generally horizontally arranged when the chainsaw 10 is resting on a horizontal surface. The pins 24 and 26 extend perpendicularly from the chassis 14 through an elongated horizontal slot 28 in the guide bar 20 with a sliding fit and align the guide bar 20 to the chassis 14. Because the spacing between the pins 24 and 26 is considerably less than the length of the slot 28, the guide bar 20 is able to slide horizontally on the pins 24 and 26 for the purpose of repositioning the guide bar 20 on the pins 24 and 26 and adjusting the tension in the cutting chain 18 as described below.

The clutch cover 30 is made of any suitable material, such as a molded plastic or a die cast metal, and provides a housing for some of the components that alternatively hold in place and release the guide bar 20 for the purpose of allowing the guide bar 20 to be repositioned so that the tension in the cutting chain 18 may be adjusted. The clutch cover 30 is tightened and loosened against the engine chassis 14 by the retaining assembly 34 for the purpose of fixing the guide bar 20 in place and releasing it, respectively. In this connection, the clutch cover 30 is removably attached to the threaded pin 26 on the engine chassis 14 by means of a rotatable knob 35 that comprises a component of the retaining assembly 34. Raised nodules or pins (not shown) may be provided on the inner facing of the clutch cover 30 to align with slots in the chassis 14 to assist in the positioning of the clutch cover 30 and the chassis 14 with respect to one another.

Turning now to FIGS. 4–7, the retaining assembly 34 is depicted in further detail in accordance with the present invention. The retaining assembly 34, in addition to the rotatable knob 35, includes a locking mechanism that is coupled to the knob 35 for alternatively locking the knob 35 against rotation about its rotational axis and unlocking the knob 35, thereby enabling the knob 35 to be rotated. The locking mechanism includes a lever 36 and a lock 37 that are pivotally coupled to the knob 35 and are operable to pivot about the knob 35 via a common axis of rotation A. The knob 35, lever 36, and lock 37 are secured together via one or more pins 38, preferably two pins. Each pin 38 extends through a respective bore provided through each of the knob 35, lever 36, and lock 37. The retaining assembly 34 further includes a torsion spring 39, which is coupled to the knob 35 at one end and to the lever 36 at its other end so as to bias the lever 36 and thus, the lock 37, toward a lowered, lock-engaging position.

The knob 35 includes a cylindrical projection 40 extending from a bottom side of the knob 35. Turning back to FIGS. 2 and 3, the cylindrical projection 40 is internally threaded so that the knob 35 can be threaded onto the threaded pin 26, thereby securing the knob 35 and the clutch cover 30 to the chassis 14. Thus, the knob 35 is rotatable between a tightened position, where the guide bar 20 is held in a fixed position between the chassis 14 and the clutch cover 30, and a loosened position, where the guide bar 20 can be moved longitudinally and repositioned. The repositioning of the guide bar 20 can be accomplished by a cooperative arrangement of the guide bar slot 28 and the pins 24 and 26. Accordingly, the rotatable knob 35 is operatively cooperative with the engine chassis 14, the clutch cover 30 and the guide bar 20 whereby the knob 35 may be rotated about its rotational axis between a tightened position and a loosened position so as to adjust the tension of the cutting chain 18 on the guide bar 20.

Turning back to FIGS. 4–7, the lock 37 includes at least one locking member adapted to engage with teeth 46 (FIG. 2) on the clutch cover 30 of the chainsaw 10 to lock the retaining assembly 34 in place. In this illustrated example, the at least one locking member includes a tooth 41, which is adapted to engage an area provided between two of the clutch cover teeth 46. The lock tooth 41 projects from the lock 37 in a direction that is parallel to an axis of rotation of the retaining assembly 34. It is to be appreciated that the lock 37 can include two or more teeth, a helical gear profile, or any other type of suitable profile for engaging with the clutch cover teeth 46 and is contemplated as falling within the scope of the present invention. For example, multiple protrusions can extend from the lock 37 for added durability and increased holding strength. Moreover, although the lock tooth 41 is illustrated herein as being tapered from one end to another, it is to be appreciated that the lock tooth 41, or whatever suitable configuration is contemplated, can be of any suitable shape and/or size. Further, because the lock 37 is provided as a separate component and the teeth 46 on the clutch cover 30 can be oriented parallel to an axis of rotation of the retaining assembly 34, an overall diametrical package size can be reduced and will hide the clutch cover teeth 46 from an outside of the retaining assembly 34.

Figure 8:
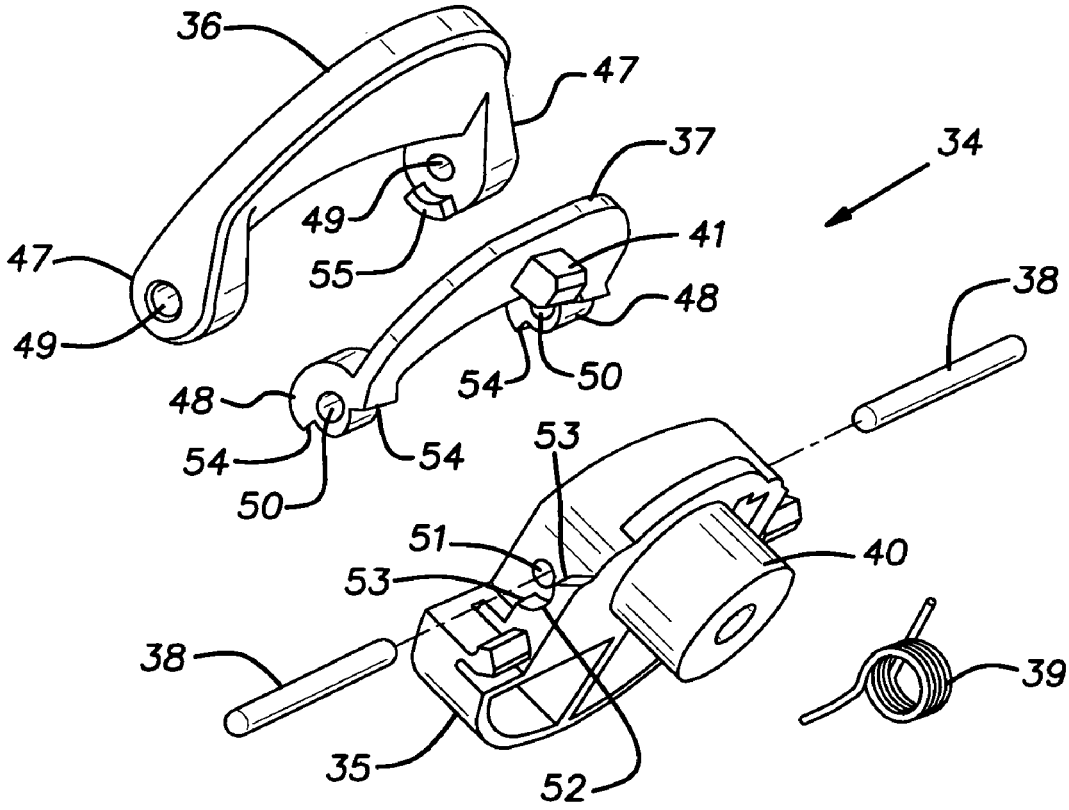
FIG. 8 is an exploded view of the retaining assembly of FIG. 4.

FIG. 8 depicts an exploded view of the retaining assembly 43 in accordance with an aspect of the present invention. Both the lever 36 and the lock 37 include arcuately shaped outer portions and generally yoke-shaped inner portions. Further, the lever 36 and the lock 37 respectively include two end portions 47 and 48, each having bores 49 and 50 provided therethrough. Although the lock 37 has the similar overall shape as the lever 36, the lock 37 is of a smaller scale such that the end portions 48 of the lock 37 fit within and abut the end portions 47 of the lever 36 and the bores 50 of the lock 37 are substantially concentrically positioned with respect to the bores 49 of the lever 36. See FIG. 6, for example. The knob 35 includes an arcuately shaped outer portion and an inner portion that is complementary with the yoke-shaped inner portion of the lever 36 and the lock 37. The knob 35 further includes a bore 51 that extends through the body of the knob 35 and is positioned such that when the lever 36 and the lock 37 are assembled with the knob 35, the knob bore 51 is substantially concentrically aligned with the lever bores 49 and the lock bores 50, thereby allowing the pins 38 to pass therethrough.

The knob 35 further includes one or more arcuately shaped cradle portions 52, which can be integrally molded with the knob body, at opposing sides of the knob 35 in which the end portions 48 of the lock 37 rest. The cradle portions 52 each include one or more lock stops 53, preferably two (e.g., one on each side of the cradle portion 52), which correspond with one or more shoulder portions 54, provided on the lock end portions 48, to stop the lock 37 from over-traveling when the lock 37 is rotated with respect to the knob 35. Thus, the cradle 52 and the lock stops 53 operate to both provide support to the lock 37 and to prevent the lock 37 from over-traveling. The lever 36 includes at least one arcuately shaped member 55 projecting from each of the end portions 47 which mates with the shoulder portions 54 of the lock 37 to allow rotary motion of the lock 37 when the lever 36 is rotated.

Figure 9:
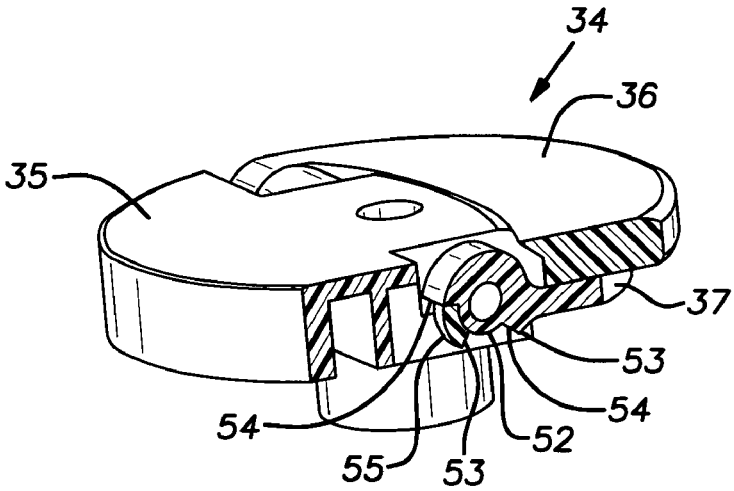
FIG. 9 is a side cross sectional view of the retaining assembly of FIG. 4.

FIG. 9 illustrates a cross sectional view of the assembled retaining assembly 34 to depict how the lock stops 53 of the knob 35, the shoulder portions 54 of the lock 37, and the arcuately shaped member 55 of the lever 36 interact with respect to each other.

Although, the retaining assembly 34 has been described as having the lock stops 53, shoulder portions 54 and arcuately shaped member 55 on each side of the retaining assembly 34, it is submitted that such components may be provided with respect to only one side of the retaining assembly 34 and is contemplated as falling within the scope of the present invention.

Figure 10:
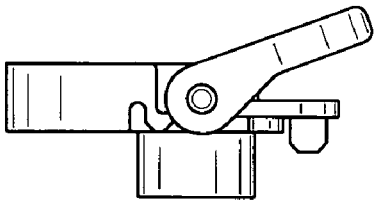
FIG. 10 is a side view of the retaining assembly of FIG. 4.
Figure 11:
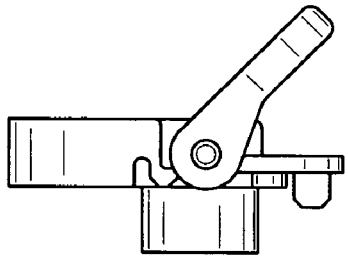
FIG. 11 is a side view of the retaining assembly of FIG. 4.
Figure 12:
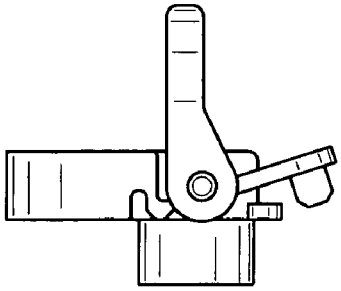
FIG. 12 is a side view of the retaining assembly of FIG. 4.

FIGS. 10–12 illustrate an example of how the retaining assembly 34 of the present invention operates. In particular, FIGS. 10–12 depict the retaining assembly 34 at three different positions during an unlocking operation. The lever 36 and lock 37 on the retaining assembly 34 work together to disengage the tooth 41 on the lock 37 from the teeth 46 in the clutch cover 30 (see FIG. 2). The lever 36 is designed so that when the lever 36 is rotated about its axis of rotation A (see FIGS. 4, 6, and 7), it will engage with the lock 37 after a certain amount of travel and force the lock 37 to rotate about the same axis A. The rotation of the lock 37 will cause the tooth 41 to rise from its original location and will thus disengage the lock tooth 41 from the mating teeth 46 in the clutch cover 30. However, as illustrated in FIGS. 10 and 11, it is noted that the lock 37 does not travel the same amount as the lever 36, as the lock 37 will only rotate when the lever 36 has reached a certain angle.

The lock 37 and knob 35 also work in conjunction with each other. The knob 35 cradles the lock 37 and includes stops 53 to mate with the shoulder portions 54 on the lock 37 when the lock 37 is in its uppermost and lowermost positions. When the lever 36 is in the down position (i.e., substantially parallel with a top plane of the knob body 35), the lock 37 is substantially parallel to the lever 36 and is forced to its lowermost position. When the lock 37 is in this position, it is possible for the tooth 41 to be engaged with the teeth 46 in the clutch cover 30. As the lever 36 is rotated upwards, the lever 36 will engage with the lock 37 at a certain angular position and rotate the lock 37 about a common axis A for a predetermined number of degrees. Such movement will cause the tooth 41 to move from its original position and disengage with the teeth 46 in the clutch cover 30, as illustrated in FIG. 12. It is noted that although the lever 36 have traveled a substantially distance, e.g., 90 degrees relative to the knob, the lock 37 has only traveled far enough to clear the teeth 46 in the clutch cover 30. Thus, the lock 37 does not interfere with a user's hand while turning the knob 35.

Turning back to the aspect of repositioning the guide bar 20 so as to adjust the tension in the cutting chain 18, it will be appreciated that the embodiments of the retaining assembly 34 described above can be utilized with various constructions, configurations, etc. for moving the guide bar 20. The illustrated embodiment for moving the guide bar 20 contains a particular set of structures; however, these structures merely provide one example for repositioning the guide bar 20 and the retaining assembly 34 of the invention can be used with other structures.

An example of a tensioning arrangement with which the retaining assembly of the present invention may be employed will now be described. It can first be seen in FIG. 2 that the elongated horizontal slot 28 in the guide bar 20 allows the guide bar to be repositioned by being moved longitudinally away from the drive sprocket 16 along slot 28 on the pins 24 and 26. This movement of the guide bar 20 takes up any slack in the cutting chain 18 and allows the requisite tension to be applied to the cutting chain 18. The guide bar 20 has an opening 60 located above the horizontal slot 28 that allows oil from an oiler (not shown) on the engine chassis 14 to provide lubrication to the guide bar and the cutting chain 18 when the chain saw is operating. Located below the slot 28 is a cylindrical opening 62 into which a cylindrical tensioner pin 64, extending perpendicularly from the plane of the guide bar 20, is pressed or otherwise fixed, preferably permanently. As illustrated in FIG. 2, the tensioner pin 64 projects beyond the guide bar 20 by a distance at least equal to the thickness of the guide bar and, preferably, by a distance about at least twice the thickness of the guide bar.

To assist in securing the guide bar 20 in a fixed position when the knob 35 is in the tightened position, a locking plate 70 is utilized. The locking plate has a slot 72 that coincides with the slot 28 in the guide bar 20 and a hole 74 through which the tensioner pin 64 passes. The locking plate 70 is positioned on the guide bar 20 by tabs 76 (FIG. 3) folded through the slot 28. An elongated high-friction surface 78 is provided above the slot 72 on the side of the locking plate 70 facing toward the clutch cover 30. The friction surface 78 may constitute a series of relatively small vertical ridges of triangular cross-section coined into the plate 70.

In the illustrated example, a cover plate 82 (FIG. 3), secured to the clutch cover 30 by a machine screw 84, is positioned to overlie the locking plate 70 by means of at least one molded locator pin 86 on the clutch cover 30 that extends into a respective locator hole 88 in the cover plate 82. Holes 90 and 92 in the cover plate 82 are aligned with and positioned over the pins 24 and 26, respectively, on the chassis 14 to fix the cover plate 82 relative to the chassis. An elongated high friction surface 94 is formed on the cover plate 82, and the friction surface 94 is aligned with the friction surface 78 on the locking plate 70.

In the illustrated example, a cam 100 (FIG. 3) is attached to a pivot pin 102 by a hex-flange locking nut 104 such that the cam is rotationally locked to the pivot pin. The cam 100 has a working edge surface, a rise area at the outer periphery of the working edge surface, and a trailing section. The cam 100 is continuously biased against the tensioner pin 64 by a torsion spring 114. The spring 114 is located in a cavity in the clutch cover 30.

The pivot pin 102 extends through the clutch cover 30 and is connected to an override lever 116 that is operable for manually adjusting the position of the guide bar 20. The override lever 116 is staked or otherwise rigidly attached to an outer end of the pivot pin 102 and is located in a molded override channel 118 on the external face of the clutch cover 30. The override lever 116 is arranged to directly follow the angular movement of the cam 100 as the cam biases the tensioner pin 64 forcing the guide bar 20 longitudinally away from sprocket 16 to remove slack from the cutting chain 18. Nomenclature, embossed or otherwise applied along the side of the override channel, to which the free end of the override lever 116 points, can indicate to the operator when the cutting chain 18 should be replaced. It will be understood that the clutch cover 30 supports the cover plate 82, the cam 100, the pivot pin 102, the lever 116, and the knob 35. It can be seen that other structural details are present on the clutch cover (e.g., see FIGS. 2 and 3), but these other structural details are not a limitation on the present invention.

When the knob 35 is rotated to the tightened position, it tightens the friction surface 94 on the cover plate 82 against the friction surface 78 on the locking plate 70. When these two surfaces are forced together, the tensioner pin 64 is locked against movement and the guide bar 20 is maintained in a fixed position. When the knob 35 is rotated to its loosened position and the pressure of the friction surfaces 78 and 94 are released, the spring-biased cam 100 forces the guide bar 20 forward to a new position, removing slack from the cutting chain 18 after which the knob 35 is rotated to the tightened position so that the guide bar is fixed in place. When the knob 35 is turned fully beyond the loosened position, the clutch cover 30 can be removed from the engine chassis 14. Usually this is done only to replace the cutting chain 18. When the clutch cover 30 is removed from the chassis 14, the cam 100 is released from the tensioner pin 64 and rotates to its most extended position under the influence of spring 114. The trailing section of the cam 100, in that case, overlies the end of the tensioner pin 64 on the guide bar 20 if the cam is not first angularly retracted by manually moving the override lever 116 counter-clockwise, as viewed in FIG. 2, against the force of the spring 114. This prevents installation of the clutch cover 30 until the cam 100 is on the proper rearward side of the tensioner pin 64. When the clutch cover 30 is again assembled onto the engine chassis 14, and the override lever 116 is released, the spring-biased cam 100 again biases the tensioner pin 64 moving the guide bar 20 to a position where the cutting chain is once more under, essentially, full tension.

In use, the operator ensures that the knob 35 is fully turned clockwise and the clutch cover assembly 30 is secured to the chassis 14. In this condition lever 36 is in its downward position and the locking tooth 41 is in engagement with the clutch cover teeth 46. As the chain saw 10 is used, the length of the cutting chain 18 will increase (e.g., the links of the cutting chain will wear at their pin joints). When the operator observes excessive slack in the cutting chain 18, the operator raises the lever 36, disengaging the locking tooth 41, and turns the knob 35 to the loosened position around its rotational axis, backing the clutch cover 30 slightly away from the chassis 14. With this action, the friction surface 94 on the cover plate 82 is released from the friction surface 78 on the locking plate 70. At the same time, the spring 114 biases the working edge surface 108 of the cam 100 against the tensioner pin 64, forcing the guide bar 20 longitudinally away from the drive sprocket 16 to a new position so as to remove the slack in the cutting chain 18. The location of the tensioner pin 64 beneath the studs 24 and 26 enables the force applied by the cam 100 to assist in overcoming the moment developed by the overhanging weight of the guide bar 20 and cutting chain 18 and provide for a smooth tensioning movement.

As the above-described adjustment of the guide bar 20 occurs, the override lever 116, which is directly attached to the spring-biased cam 100, moves upward in the override channel 118 to a new position. If need be, the override lever 116 can be manually advanced to assist the spring 114. The indicia associated with the override lever 116 and the override channel 118 indicates the extent to which the cutting chain has been extended. For example, the indicia may include a legend, such as "REPLACE CHAIN" to indicate when the chain has been elongated to the point of needing to be replaced. Such an arrangement is disclosed in U.S. Pat. No. 6,560,879, the entire disclosure of which is incorporated herein by reference.

Once the guide bar 20 has been adjusted and the cutting chain 18 has had any slack removed, the knob 35 is rotated back to the tightened position and the lever 36 is pivoted downwardly forcing the locking tooth 41 downward and into engagement with the corresponding teeth 46 clutch cover, thereby securing the knob 35 in the tightened position.

It will be understood based on the foregoing, that the retaining assembly 34 of the invention can be employed with tensioning arrangements other than as described above. For example, the retaining assembly 34 of the invention can be used in the absence of a spring-biased cam and associated elements automatically move the guide bar 20 to a new position. In that case, the guide bar 20 can be repositioned by any suitable mechanical means other than the cam and pivot pin assembly described above.

The present invention can provide various advantages. For example, the present invention can enable an operator to make adjustments to the guide bar 20 without additional tools. Additionally, the present invention provides for a positive securing of the knob 35 against unwanted rotational movement while allowing for the ready release of the knob 35 when rotational movement is desired.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A retaining assembly for adjusting a tension of a cutting chain of a chainsaw having an engine chassis, a clutch cover having teeth, and a guide bar for the cutting chain, the retaining assembly comprising:

a rotatable knob for operative coupling to the engine chassis, the clutch cover, and the guide bar, wherein the knob is rotated about a rotational axis between a tightened position, in which the guide bar is fixed in place between the engine chassis and the clutch cover, and a loosened position, in which the guide bar is loosened and can be repositioned to adjust the tension of the cutting chain on the guide bar;

a lock operatively coupled to the rotatable knob and having at least one locking member projecting in a direction that is parallel to an axis of rotation of the rotatable knob; and a lever operatively coupled to the rotatable knob and the lock such that movement of the lever moves the at least one locking member into and out of engagement with the teeth provided on the clutch cover.

2. The retaining assembly of claim 1, wherein the lock and the lever are pivotally coupled to the rotatable knob about a common axis of rotation.

3. The retaining assembly of claim 1, further comprising at least one pin to couple the rotatable knob, the lock, and the lever together.

4. The retaining assembly of claim 1, wherein the at least one locking member is at least one tooth that is adapted to engage an area between two of the clutch cover teeth.

5. The retaining assembly of claim 1, wherein the at least one locking member has at least one tooth profile.

6. The retaining assembly of claim 1, further comprising a torsion spring to bias the lever and the lock in a lock engaging position.

7. The retaining assembly of claim 1, wherein the knob includes a cylindrical projection adapted to engage a pin that is secured to the chassis.

8. The retaining assembly of claim 1, wherein the knob is of a size that hides the clutch cover teeth from view.

9. The retaining assembly of claim 1, wherein the knob includes at least one lock stop to prevent at least one of the lever and the lock from over-traveling.

10. The retaining assembly of claim 9, wherein the lock includes at least one shoulder portion to engage the at least one lock stop to prevent the lock from over-traveling.

11. The retaining assembly of claim 10, wherein the lever includes at least one arcuately shaped member projecting from at least one end portion of the lever, the arcuately shaped member being adapted to mate with the at least one shoulder portion to allow rotary motion of the lock when the lever is rotated.

12. A retaining assembly for adjusting a tension of a cutting chain of a chainsaw comprising:

rotatable means for repositioning a guide bar to adjust the tension of the cutting chain;

locking means for engaging and disengaging with teeth on a clutch cover of the chainsaw in a direction parallel to an axis of rotation for the rotatable means; and lever means for pivoting the locking means to effect actuation of the locking means.

13. The retaining assembly of claim 12, wherein the locking means and the lever means pivot about a common axis.

14. The retaining assembly of claim 12, wherein the lever means only effects actuation of the locking means after the lever means has been pivoted to a predetermined angle.

* * * * *

UNITED STATES PATENT AND TRADEMARK OFFICE

CERTIFICATE OF CORRECTION

PATENT NO. : 7,107,689 B2
APPLICATION NO. : 10/961107
DATED : September 19, 2006
INVENTOR(S) : Keeton et al.

It is certified that error appears in the above-identified patent and that said Letters Patent is hereby corrected as shown below:

Column 4, line 44, please delete “43” and insert --34--

Signed and Sealed this

Twenty-sixth Day of December, 2006

JON W. DUDAS
*Director of the United States Patent and Trademark Office*